United States Patent [19]

Modig

[11] Patent Number: 4,544,087

[45] Date of Patent: Oct. 1, 1985

[54] HOLDER FOR LIQUIDS

[76] Inventor: Ronald Modig, Odlingsvägen 17, S-138 00 Älta, Sweden

[21] Appl. No.: 491,193

[22] PCT Filed: Aug. 12, 1982

[86] PCT No.: PCT/SE82/00257

§ 371 Date: Apr. 12, 1983

§ 102(e) Date: Apr. 12, 1983

[87] PCT Pub. No.: WO83/00608

PCT Pub. Date: Mar. 3, 1983

[30] Foreign Application Priority Data

Aug. 14, 1981 [SE] Sweden ..... 8104849-8

[51] Int. Cl.[4] ..... A45F 3/16

[52] U.S. Cl. ..... 224/148

[58] Field of Search ..... 224/148, 209, 259, 260, 224/255, 205, 206, 265

[56] References Cited

U.S. PATENT DOCUMENTS

| | | | |
|---|---|---|---|
| 2,672,263 | 3/1954 | Alber | 224/205 |
| 2,717,109 | 9/1955 | Walsh | 224/148 |
| 3,547,322 | 12/1970 | Dawson et al. | 224/148 |
| 3,843,032 | 10/1974 | Moran et al. | 224/148 |
| 4,090,650 | 5/1978 | Gotta | 224/148 |
| 4,139,130 | 2/1979 | Glusker et al. | 224/148 |
| 4,176,772 | 12/1979 | Danon | 224/148 |

*Primary Examiner*—Steven M. Pollard

*Attorney, Agent, or Firm*—Handal & Morofsky

[57] ABSTRACT

Portable holder for liquids intended to be carried over the shoulders which comprises two exchangeable plastic bags, one on the stomach and one on the back, for the liquid, which are firmly secured to a harness, which are connected by means of a tube comprising two non-return valves, which prevent the liquid from flowing from one bag to the other. The contents of the bags are consumed simultaneously on consumption of the liquid by suction via the tube or tubes.

6 Claims, 1 Drawing Figure

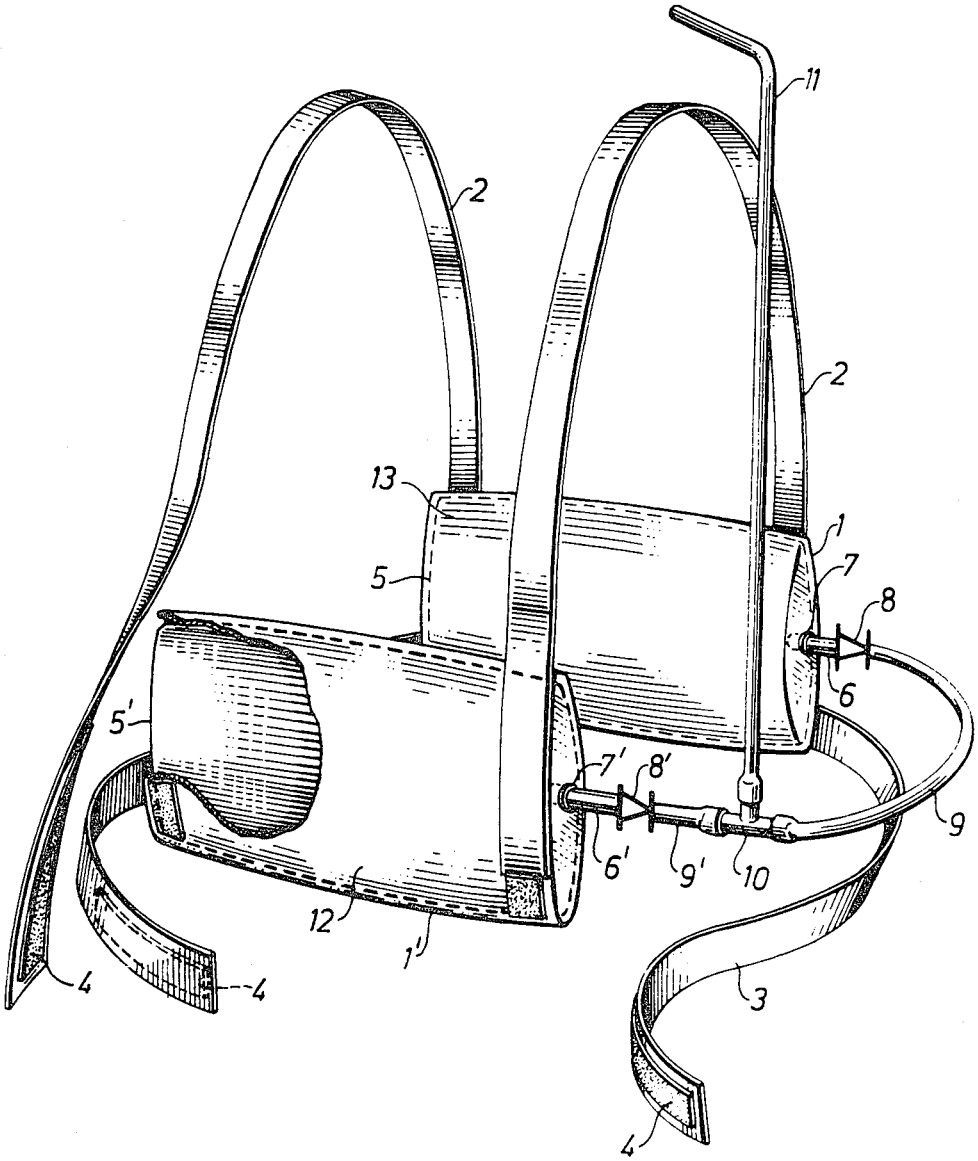
11
2
2
13
1
5
7
8
6
5'
7'
8'
9
6'
9'
10
12
1'
4
4
3
4

HOLDER FOR LIQUIDS

The present invention relates to a portable holder for liquids suitable for use in sporting activities, such as by long distance runners and other long distance sportsmen, and in general when the user wishes to keep his hands free.

The portable holder for liquids is intended to be carried on the shoulders and consists of two exchangeable plastic bags one on the stomach and one on the back which are firmly secured to a harness. They are connected by means of a tube having non-return valves so that the liquid shall not run over from one bag to the other, or in any way flow back. Thus, air is prevented from flowing into the bags, thereby preventing the liquids from swishing about and forming froth. If air is allowed to flow into the bags this would mean that the person drinking the liquid would also swallow a considerable amount of air, which causes great discomfort and gives rise to tension in the stomach and in many cases causes stitch.

The liquid can be drunk when the user so wishes through a suction-tube at chin level, and is kept warm by body-temperature.

The holder for liquids is suitably provided with insulation means on the part of the outer surface which does not rest against the body. Thereby, the liquid is kept warm by body temperature. It is important that the liquid is not too cold when consumed and it should have a temperature around 26° C. which is a physiologically suitable temperature. The consuming of a too cold drink, for instance during a marathon run, gives rise to symptoms of discomfort and lowers the height of performance.

The weight of the liquid is distributed evenly between the fron and back bag, and these are emptied simultaneously when the user drinks. This prevents uneven distribution—which can effect balance—the weight of the liquid is always distributed equally between the front and back bag.

With the device according to the present invention the user is not dependent upon liquid controls when training, and the consuming of liquid can take place without the need for a pause, which of course is a great advantage. Another advantage is, of course, that the hands and arms do not need to be engaged in the transporting of the liquid. Because the bags are exchangeable, the user can easily replace them when the liquid is exhausted, or if he wishes for some reason to replace one liquid by another liquid. Such a change can take place without difficulty and in a short space of time.

The appended drawing illustrates the device according to the present invention. The FIGURE shows a pair of outer bags 1 and 1', which when in use are kept together by a pair of shoulder straps 2 and a waist strap 3. These straps can, for example, be sewn onto the back outer bag 1, which is intended to be carried on the back, and firmly connected to the front bag 1', which is intended to be carried on the front part of the body, with so called Velcro ®-strips 4. These straps, especially the strap 3, can, if so desired, consist of an elastic resilient material, for example elastic or rubber or similar material. Usually, the tightness of the belt must be adjusted when the holders for the liquid gradually empties, but if the band is made elastic this adjustment may be superfluous.

In the outer holders 1 and 1' there are arranged inner casings 5 and 5', of which casing 5' is shown on the drawing by a cut away section of the outer casing 1'. These holders are suitably provided with a connecting piece 6, 6' respectively, which extend out through an opening 7, 7' respectively, in the outer holders. To the connection piece 6, 6' respectively, are attached nonreturn valves 8, 8' respectively, which are shown diagrammatically on the drawing and which allow an outflow from the inner holders but prevent return flow to them. From the nonreturn valves connecting tubes 9, 9' respectively extend to a T-pipe 10, on which at its third opening a suction tube 11 is connected, which extends up to a suitable mouth level. As can be seen from the cut away section, the side 12 of the outer holders 1, 1' respectively not facing the body are heat insulated, while the parts 13 facing the body are comprised of material which allows the body temperature to easily pass to the liquid which is contained in the inner casing 5. The sides 13 facing the body of the inner casing can comprise of a netlike material, for example mosquito net or a similar material. The shoulder straps 2, intended for carrying and the waist strap 3 can be of a standard length and can, for example, be cut to a suitable length for the individual user.

I claim:

1. Portable holder for liquids intended to be carried over the shoulders, characterized in that it comprises two exchangeable plastic bags, one on the stomach and one on the back, for the liquid, which are firmly secured to a harness which are connected by means of a tube comprising two nonreturn valves, which prevent the liquid from flowing from one bag to the other and whereby the contents of the bags are consumed simultaneously on consumption of the liquid by suction via the tube or tubes.

2. Portable holder for liquids according to claim 1, characterized in that it is provided with insulation on the part of the outer surface which does not face the body and thereby the liquid is kept warm by body temperature.

3. A portable holder for liquids, comprising, (a) a first impermeable bag;

(b) a second impermeable bag;

(c) harness means adapted to be secured to a user, said harness means being disposed over the shoulders of said user and over the front and back of the torso of the user;

(d) first attachment means for securing said first impermeable bag against the front of the torso of the user;

(e) second attachment means for securing said second impermeable bag against the back of the torso of the user;

(f) tube means for conveying the contents of said bags to the mouth of said user;

(g) valve means associated with said tube means for preventing the liquid from flowing from one bag to the other and for allowing the application of suction to said tube means to simultaneously cause the removal of liquid from said first and second impermeable bags.

4. A portable holder for liquids as in claim 3 wherein said tube means comprises a connecting tube means extending between said first and second impermeable bags, first valve means disposed proximate to said first impermeable bag for permitting the flow of liquids from said first impermeable bag, second valve means disposed in said connecting tube means for permitting the flow of liquid from said second impermeable bag, manifold means disposed in said connecting tube means between said first and second valve means and suction tube means communicating with said connecting tube means via said manifold means.

5. A portable holder for liquids as in claim 3, wherein said first and second impermeable bag comprises an impermeable liner contained within an outer casing, said outer casing including an insulated outer surface encompassing those parts of the outer casing which do not face the torso of the user.

6. A portable holder for liquids as in claim 5, wherein the portions of said outer casing facing the torso of the user are comprised of a material which provides for the transfer of heat from the torso of the user to said permeable bag.

* * * * *